US006883904B2

(12) United States Patent
Jeanmaire et al.

(10) Patent No.: US 6,883,904 B2
(45) Date of Patent: Apr. 26, 2005

(54) APPARATUS AND METHOD FOR MAINTAINING CONSTANT DROP VOLUMES IN A CONTINUOUS STREAM INK JET PRINTER

(75) Inventors: David L. Jeanmaire, Brockport, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 41 days.

(21) Appl. No.: 10/131,533

(22) Filed: Apr. 24, 2002

(65) Prior Publication Data

US 2003/0202055 A1 Oct. 30, 2003

(51) Int. Cl.[7] ..... B41J 2/105
(52) U.S. Cl. ..... 347/82
(58) Field of Search ..... 347/15, 21, 82, 347/73, 76–77, 81, 5–6, 75

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,709,432 A | | 1/1973 | Robertson | |
| 3,878,519 A | | 4/1975 | Eaton | |
| 3,916,421 A | | 10/1975 | Hertz | |
| 3,979,756 A | | 9/1976 | Helinski et al. | |
| 4,148,718 A | | 4/1979 | Fulwyler | |
| 4,230,558 A | | 10/1980 | Fulwyler | |
| 4,292,640 A | * | 9/1981 | Lammers et al. | 347/21 |
| 4,318,483 A | | 3/1982 | Lombardo et al. | |
| 4,346,387 A | | 8/1982 | Hertz | |
| 4,646,106 A | | 2/1987 | Howkins | |
| 4,714,931 A | | 12/1987 | Erskine et al. | |
| 4,860,027 A | * | 8/1989 | Ozelis et al. | 347/7 |
| 5,160,939 A | * | 11/1992 | Bajeux et al. | 347/78 |
| 5,396,273 A | * | 3/1995 | Stamer | 347/78 |
| 5,418,557 A | * | 5/1995 | Pullen | 347/7 |
| 5,623,292 A | | 4/1997 | Shrivastava et al. | |
| 5,644,343 A | | 7/1997 | Allen | |
| 5,646,663 A | | 7/1997 | Clark et al. | 347/75 |
| 5,754,194 A | * | 5/1998 | Endo et al. | 347/15 |
| 6,079,821 A | | 6/2000 | Chwalek et al. | |
| 6,364,457 B1 | * | 4/2002 | Colecchi et al. | 347/47 |
| 6,505,921 B2 | * | 1/2003 | Chwalek et al. | 347/77 |

FOREIGN PATENT DOCUMENTS

| | | |
|---|---|---|
| EP | 0551967 | 7/1993 |
| JP | 2002036595 | 2/2002 |

* cited by examiner

*Primary Examiner*—K. Feggins
(74) *Attorney, Agent, or Firm*—William R. Zimmerli

(57) ABSTRACT

A method an apparatus for maintaining a predetermined ejected ink drop volume in a continuous inkjet printer is provided. An ink parameter, for example, temperature, velocity, flow rate, viscosity, is monitored. A time period between activation control signals provided to an ink drop forming mechanism is varied in response to a change in the ink parameter. The apparatus includes an ink parameter monitoring device which provides an input signal to a controller. The controller varies the time period between activation control signals provided to the ink drop forming mechanism.

33 Claims, 11 Drawing Sheets

APPARATUS AND METHOD FOR MAINTAINING CONSTANT DROP VOLUMES IN A CONTINUOUS STREAM INK JET PRINTER

FIELD OF THE INVENTION

The present invention relates generally to ink jet printers, and more particularly to compensating for inconsistencies in ejected drop volumes.

BACKGROUND OF THE INVENTION

Continuous ink jet (also commonly referred to as continuous stream, etc.) printing systems, use a pressurized ink source and a drop forming mechanism for producing a continuous stream of ink drops. Conventional continuous ink jet printers utilize electrostatic charging devices that are placed close to the point where a filament of working fluid breaks into individual ink drops. The ink drops are electrically charged and then directed to an appropriate location by deflection electrodes having a large potential difference. For example, when no printing is desired, the ink drops (non-printed drops, etc) are deflected into an ink capturing mechanism (catcher, interceptor, gutter, etc.) and either recycled or discarded while non-deflected ink drops (printed drops, etc.) are permitted to contact a recording media. Alternatively, printed ink drops can be deflected toward the recording media while non-deflected non-printed ink drops travel toward the ink capturing mechanism.

As drops are continuously being formed and selectively deflected during operation, print quality and system performance in continuous ink jet printers is particularly sensitive to variations in drop volume (drop size, etc.). Variations in drop volume can cause the printed dot size on the recording media to vary which can adversely affect print quality. For example, when the volume of ejected drops increases or decreases while a page of recording media is being printed, the colors printed at the top of the page can be inconsistent with the colors printed at the bottom of the page. This can affect the darkness of black-and-white text, the contrast of gray-scale images, and the saturation, hue, and lightness of color images. Additionally, variations in drop volume can adversely affect system performance. For example, the drop deflection mechanism may not consistently deflect drops when the drop volume varies. This can result in an increase or a decrease in the deflection angle causing drops to be deflected too much or not enough.

A change in ink viscosity caused by, for example, a change in operating temperature can cause drop volumes to vary. While changes in ink viscosity caused by the evaporation of the solvent component of the ink composition can be compensated for measuring either the optical absorbency or the electrical conductivity of the ink and adding make-up solvent accordingly, ink viscosity is also a function of temperature. For example, a drop forming mechanism that provides drops having a desired volume at normal ambient room temperature (e.g., 60°–82° F.) can provide drops having a larger undesired volume when the surrounding temperature increases (e.g., 85°–95° F.). The extra ink provided by the drop forming mechanism degrades the print quality by causing an increase in the density of the printed dot. Alternatively, the drop forming mechanism can provide drops having a smaller undesired volume when the surrounding temperature decreases which can also degrade print quality.

Even when the printer is located in a room that is successfully maintained within a normal ambient temperature range, the temperature of the printhead housing the drop forming mechanism can increase beyond acceptable ambient temperatures due to, for example, the heat generated by forming and/or deflecting the drops. Again, this produces a variation in drop volume which can adversely affect print quality. In these situations, adding solvent or ink concentrate to the ink composition to compensate for the temperature induced viscosity changes produces an ink composition having unintended property changes, for example changes in optical density and, as such, is an inadequate solution to the problem.

U.S. Pat. No. 5,623,292 issued to Shrivastava et al. on Apr. 22, 1997, provides a temperatures control unit in a printhead in order to control ink temperature. The temperature control unit includes a heat pump assembly coupled to a heat exchanger through which the ink flows. However, this solution is disadvantaged in that it requires additional hardware for the heating and/or cooling the ink which increases the cost of the printer. Additional time is also required prior to printing in order to permit the ink to reach a desired temperature.

As such, there is a need to be able to monitor changes in ink parameters (for example, ink viscosity) caused by changes in operating conditions (for example, temperature) in order to compensate for inconsistencies in drop volumes without controlling the temperature of the print head.

SUMMARY OF THE INVENTION

A method of maintaining an ejected ink drop volume in a continuous inkjet printer includes determining a change in an ink parameter; and varying a time period between activation control signals provided to an ink drop forming mechanism in response to the change in the ink parameter.

An apparatus for continuously ejecting ink includes a printhead. Portions of the printhead define a delivery channel and a nozzle bore with the delivery channel and nozzle bore defining an ink flow path. A drop forming mechanism is positioned proximate to the ink flow path and forms drops from ink moving along the ink flow path. An ink parameter sensing device is positioned proximate to the ink flow path. A controller is in electrical communication with the drop forming mechanism and the ink parameter sensing device. The controller is configured to vary a time period between activation control signals provided to the drop forming mechanism in response to a change in an output signal received from the ink parameter sensing device.

BRIEF DESCRIPTION OF THE DRAWINGS

Other features and advantages of the present invention will become apparent from the following description of the preferred embodiments of the invention, and the accompanying drawings, wherein.

DETAILED DESCRIPTION OF THE INVENTION

The present invention will be directed in particular to elements forming part of, or cooperating more directly with, apparatus in accordance with the present invention. It is to be understood that elements not specifically shown or described may take various forms well known to those skilled in the art.

Figure 1:
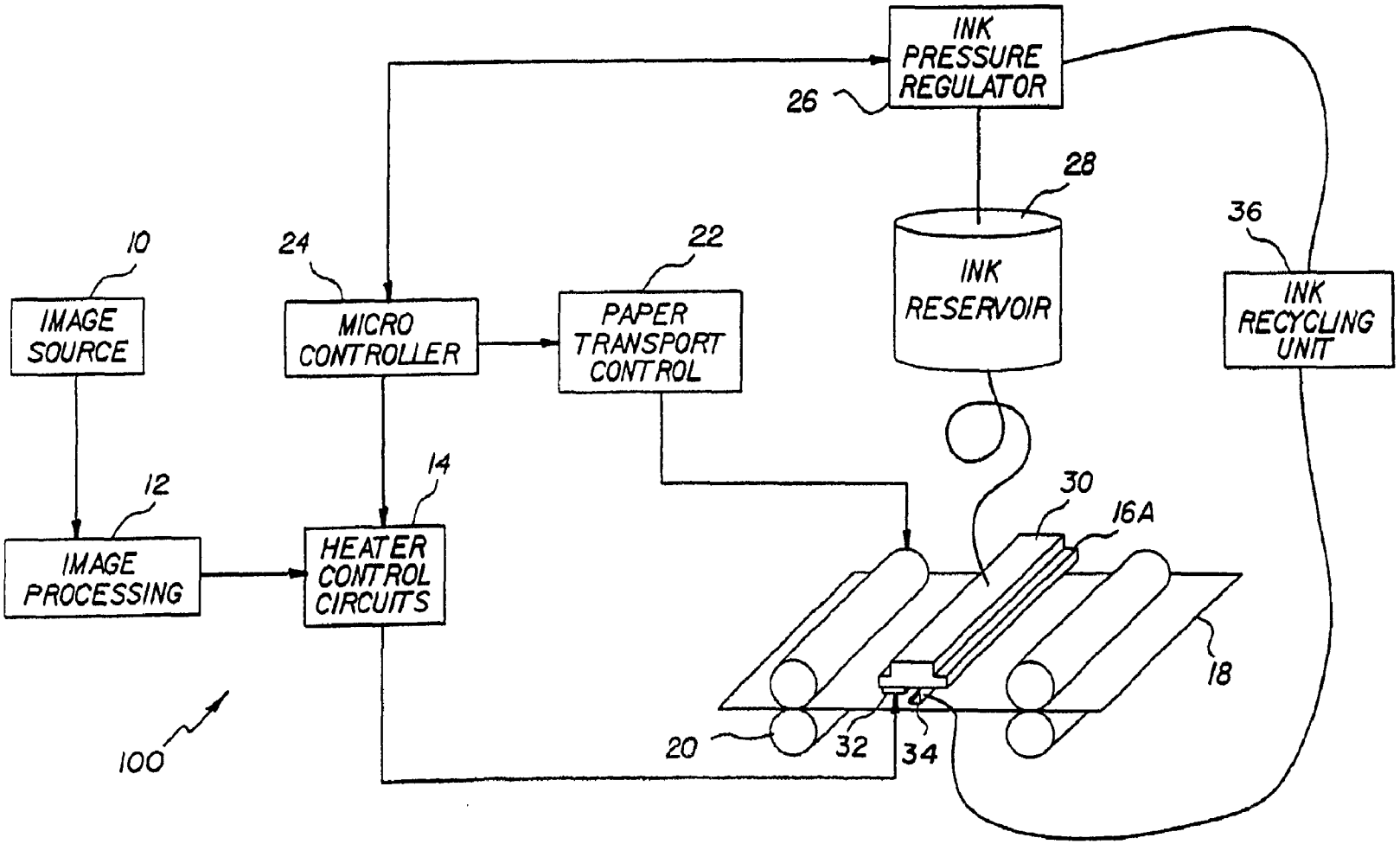
FIG. 1 is a schematic diagram of a printing apparatus incorporating the present invention.
Figure 2:
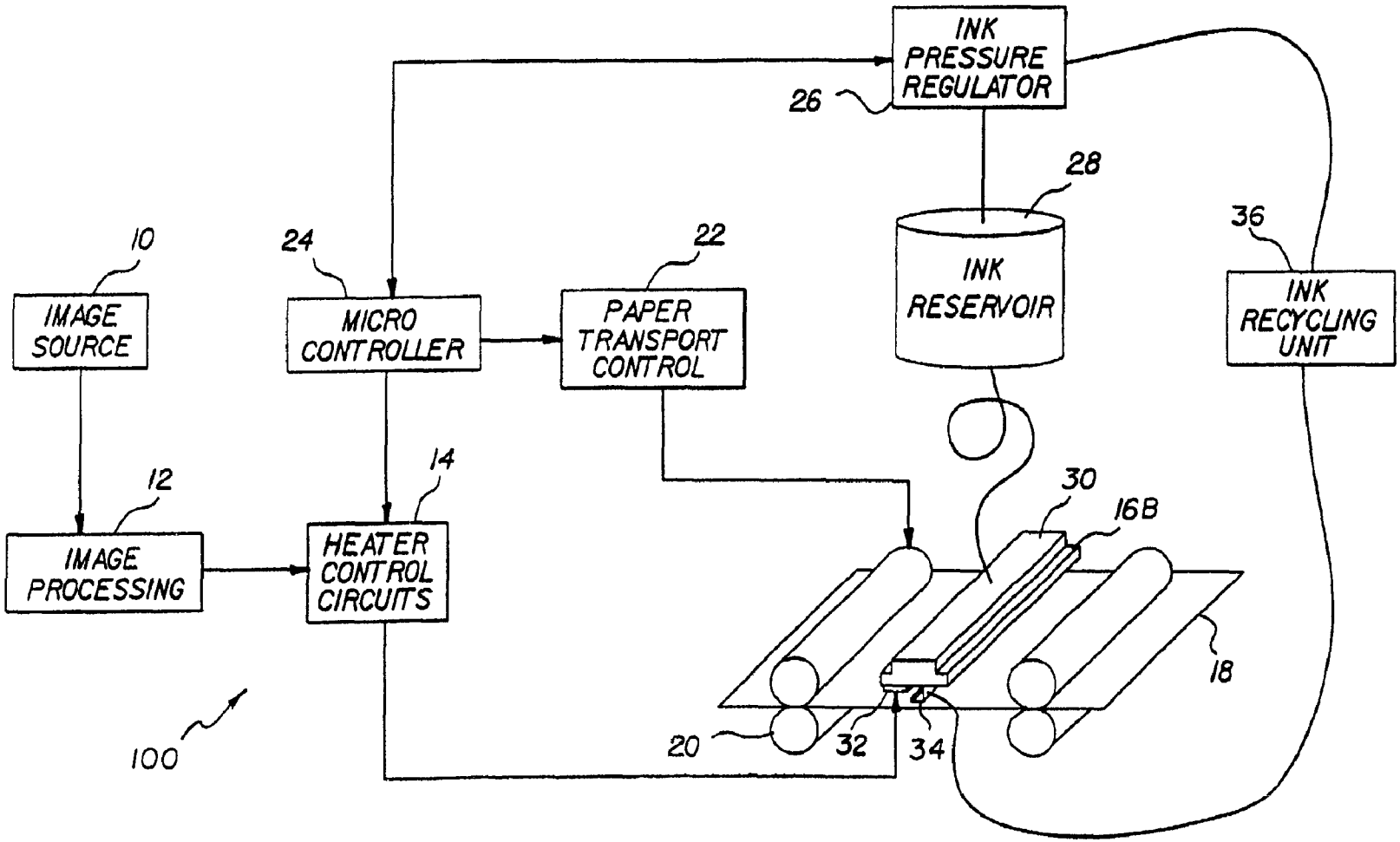
FIG. 2 is a schematic diagram of a printing apparatus incorporating the present invention.

Referring to FIGS. 1 and 2, a continuous ink jet printer system 100 incorporating the present invention is shown. The system 100 includes an image source 10 such as a scanner or computer which provides raster image data, outline image data in the form of a page description language, or other forms of digital image data. This image data is converted to half-toned bitmap image data by an image processing unit 12, which also stores the image data in memory. A heater control circuit 14 reads data from the image memory and applies electrical pulses to a heater 32 that is part of a printhead 16A or a printhead 16B. These pulses are applied at an appropriate time, so that drops formed from a continuous ink jet stream will print spots on a recording medium 18 in the appropriate position designated by the data in the image memory. The printhead 16A, shown in FIG. 1, is commonly referred to as a page width printhead, while the printhead 16B, shown in FIG. 2, is commonly referred to as a scanning printhead.

Recording medium 18 is moved relative to printhead 16A, 16B by a recording medium transport system 20 which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads 16A, it is most convenient to move recording medium 18 past a stationary printhead 16B. However, in the case of scanning print systems, it is usually most convenient to move the printhead 16B along one axis (the sub-scanning direction) and the recording medium along an orthogonal axis (the main scanning direction) in a relative raster motion.

Ink is contained in an ink reservoir 28 under pressure. In the nonprinting state, continuous ink jet drop streams are unable to reach recording medium 18 due to an ink gutter 34 that blocks the stream and which may allow a portion of the ink to be recycled by an ink recycling unit 36. The ink recycling unit reconditions the ink and feeds it back to reservoir 28. Such ink recycling units are well known in the art. The ink pressure suitable for optimal operation will depend on a number of factors, including geometry and thermal properties of the nozzle bores (shown in FIG. 3) and thermal properties of the ink. A constant ink pressure can be achieved by applying pressure to ink reservoir 28 under the control of ink pressure regulator 26.

System 100 can incorporate additional ink reservoirs 28 in order to accommodate color printing. When operated in this fashion, ink collected by gutter 34 is typically collected and disposed.

The ink is distributed to the back surface of printhead 16A, 16B by an ink channel 30. The ink preferably flows through slots and/or holes etched through a silicon substrate of printhead 16A, 16B to its front surface where a plurality of nozzles and heaters are situated. With printhead 16A, 16B fabricated from silicon, it is possible to integrate heater control circuits 14 with the printhead. Printhead 16A, 16B can be formed using known semiconductor fabrication techniques (CMOS circuit fabrication techniques, micro-electro mechanical structure MEMS fabrication techniques, etc.). Printhead 16A, 16B can also be formed from semiconductor materials other than silicon.

Figure 3:
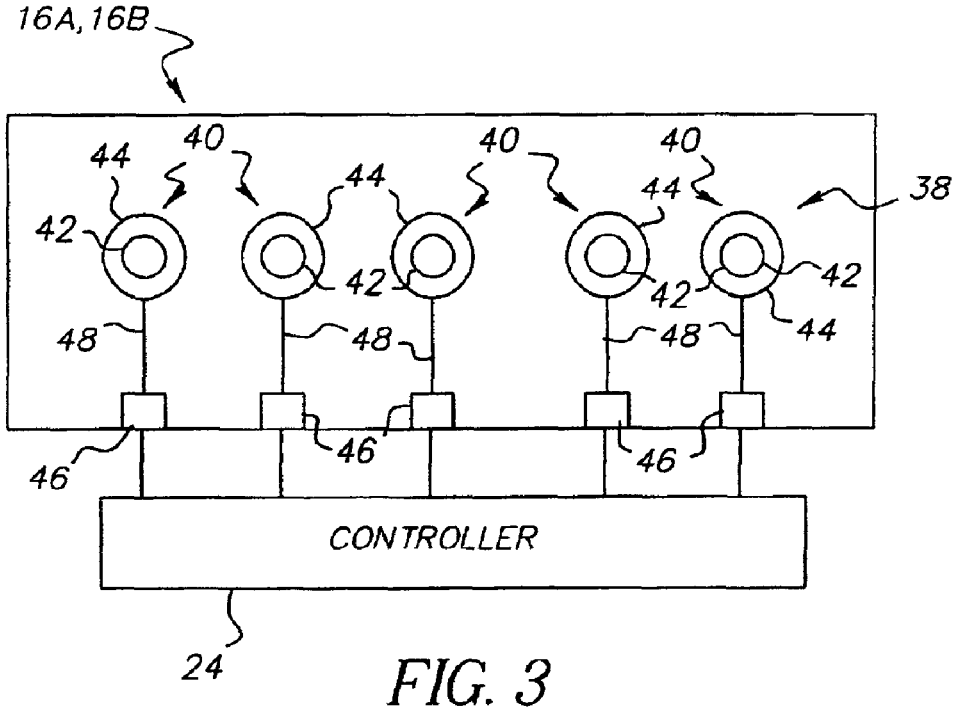
FIG. 3 is a top view of a printhead having a drop forming mechanism incorporating the present invention.

Referring to FIG. 3, printhead 16A, 16B is shown in more detail. Printhead 16A, 16B includes a drop forming mechanism 38. Drop forming mechanism 38 can include a plurality of heaters 40 positioned on printhead 16A, 16B around a plurality of nozzle bores 42 formed in printhead 16A, 16B. Although each heater 40 may be disposed radially away from an edge of a corresponding nozzle bore 42, heaters 4 are preferably disposed close to corresponding nozzle bores 42 in a concentric manner. Typically, heaters 40 are formed in a substantially circular or ring shape. However, heaters 40 can be formed in other shapes. Typically, each heater 40 comprises a resistive heating element 44 electrically connected to a contact pad 46 via a conductor 48. Contact pads 46 and conductors 48 form a portion of the heater control circuits 14 which are connected to controller 24. Alternatively, other types of heaters can be used with similar results.

Figure 4:
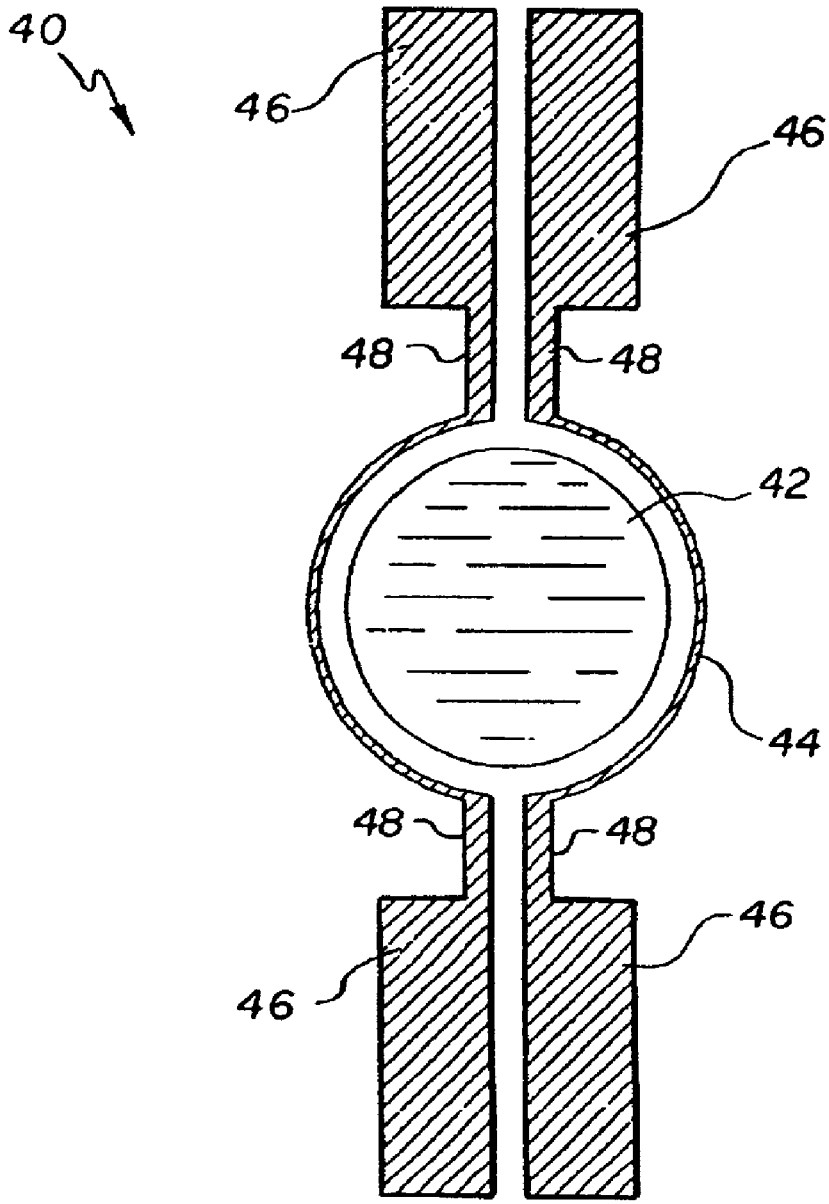
FIG. 4 is a top view of a drop forming mechanism and a drop deflector system incorporating the present invention.

Heaters 40 are selectively actuated to from drops, for example as described in commonly assigned U.S. Pat. No. 6,079,821,entitled CONTINUOUS INK JET PRINTER WITH ASYMMETRIC HEATING DROP DEFLECTION. Additionally, heaters 40 can be selectively actuated to deflect drops, for example as described in commonly assigned U.S. Pat. No. 6,079,821. When heaters 40 are used to form and deflect drops, heaters 40 can be asymmetrical relative to nozzle bores 42, as shown in FIG. 4 and described in commonly assigned U.S. Pat. No. 6,079,821.

Referring to FIG. 4, heater 40 has two sections covering approximately one half of a perimeter of the nozzle bore 42. Each section of heater 40 comprises a resistive heating element 44 electrically connected to a contact pad 46 via a conductor 48. Alternatively, drop deflection can be accomplished in any known fashion (electrostatic deflection, etc.)

Figure 5:
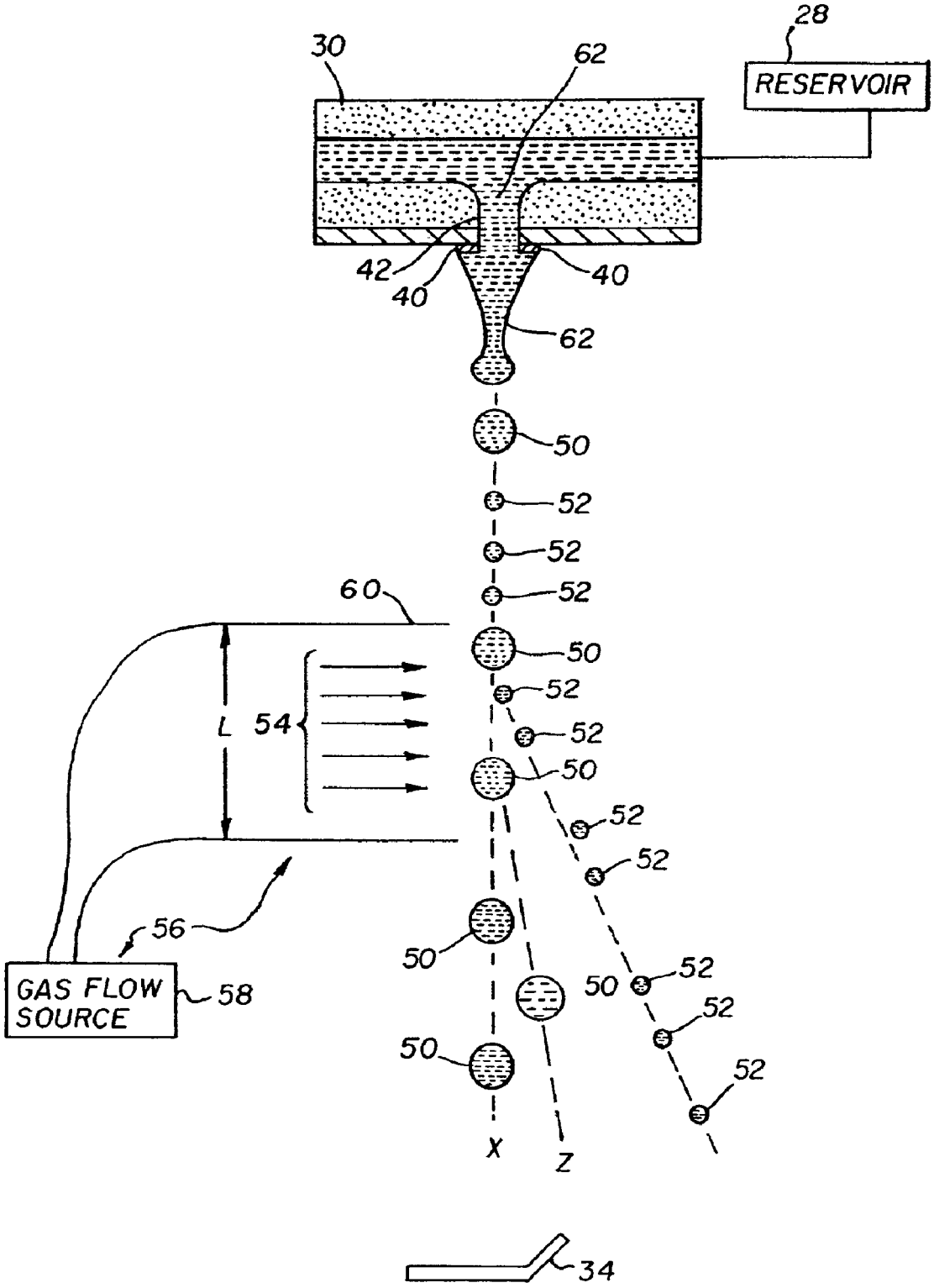
FIG. 5 is a schematic side view of printhead having a drop forming mechanism and a drop deflector system incorporating the present invention.

Drop deflection can also be accomplished by applying a gas flow to drops having a plurality of volumes as described in commonly assigned, currently pending U.S. patent application Ser. Nos. 09/751,232, and 09/750,946, and with reference to FIG. 5. Drop deflection can be accomplished by actuating drop forming mechanism 38 (for example, heater 40) such that drops of ink 62 having a plurality of volumes 50, 52 travelling along a path X are formed. A gas flow 54 supplied from a drop deflector system 56 including a gas flow source 58 is continuously applied to drops 50, 52 over an interaction distance L. As drops 50 have a larger volume (and more momentum and greater mass) than drops 52, drops 52 deviate from path X and begin travelling along path Y, while drops 50 remain travelling substantially along path X or deviate slightly from path X and begin travelling along path Z. With appropriate adjustment of gas flow 54, and appropriate positioning of gutter 34, drops 52 contact a print media while drops 50 are collected by gutter 34. Alternatively, drops 50 can contact the print media while drops 52 are collected by gutter 34.

Typically, an end 60 of the droplet deflector system 56 is positioned along path X. Gases, including air, nitrogen, etc., having different densities and viscosities can be incorporated into the droplet deflector system 56. Additionally, the gas flow can either be a positive pressure and velocity force or a negative pressure and velocity force (negative gas flow, vacuum, etc.).

Referring to FIGS. 6A–6D, printhead 16A, 16B also has at least one temperature sensing device(s) 64 positioned proximate to nozzle bore 42 for sensing the temperature of the ink ejected from the system 100 either just prior to the ink being ejected from printhead 16A, 16B or just after the ink has been ejected from printhead 16A, 16B. Temperature sensing device 64 can include a temperature sensing diode, a resistor, etc. In a preferred embodiment, temperature sensing device 64 includes elements (e.g. a diode(s)) that are easily formed with standard silicon fabrication techniques, and may be placed in one or more locations, so that ink temperatures can be determined across the entire printhead 16A, 16B. Alternatively, heater 40 can be used for temperature sensing provided heater 40 has a non-zero temperature coefficient of resistance. When heater 40 is used to measure ink temperature, the current flow through heater 40 is measured when heater 40 is activated.

Figure 6A:
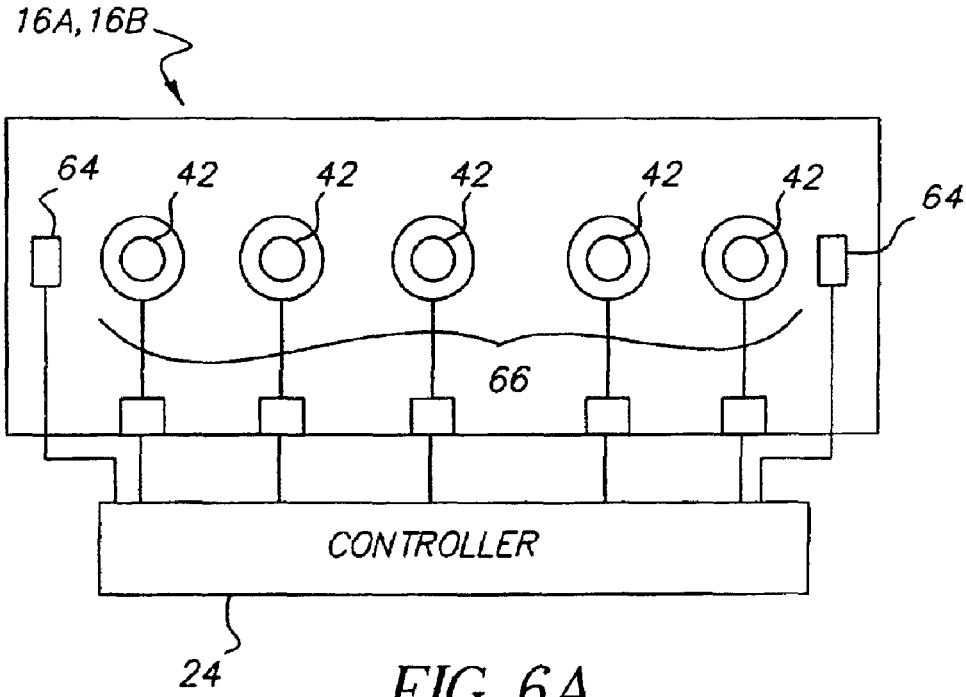
FIGS. 6A and 6B are top views of a printhead incorporating the present invention.
Figure 6B:
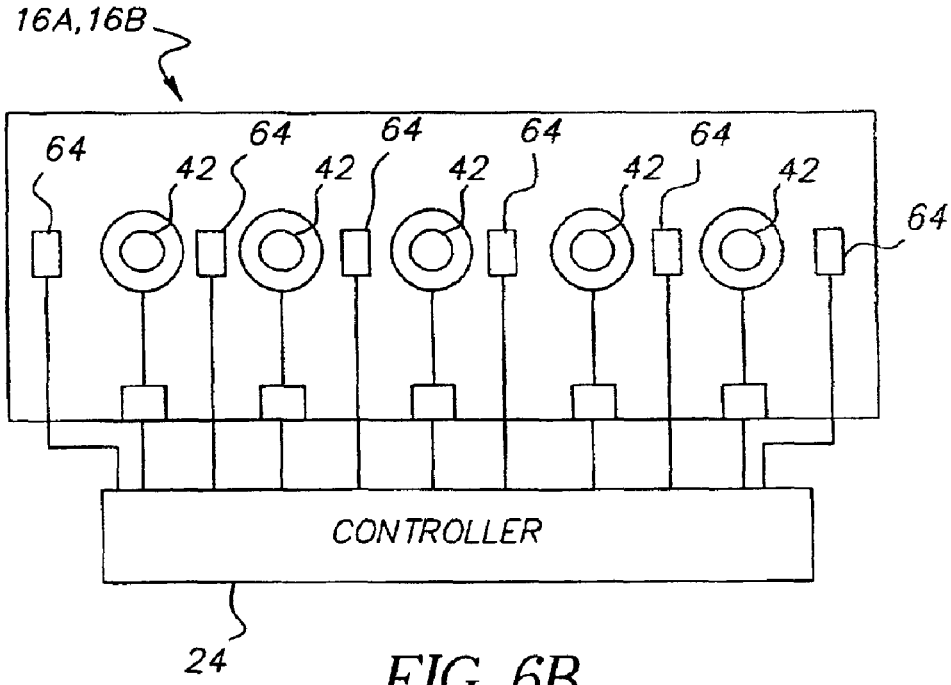
Figure 6C:
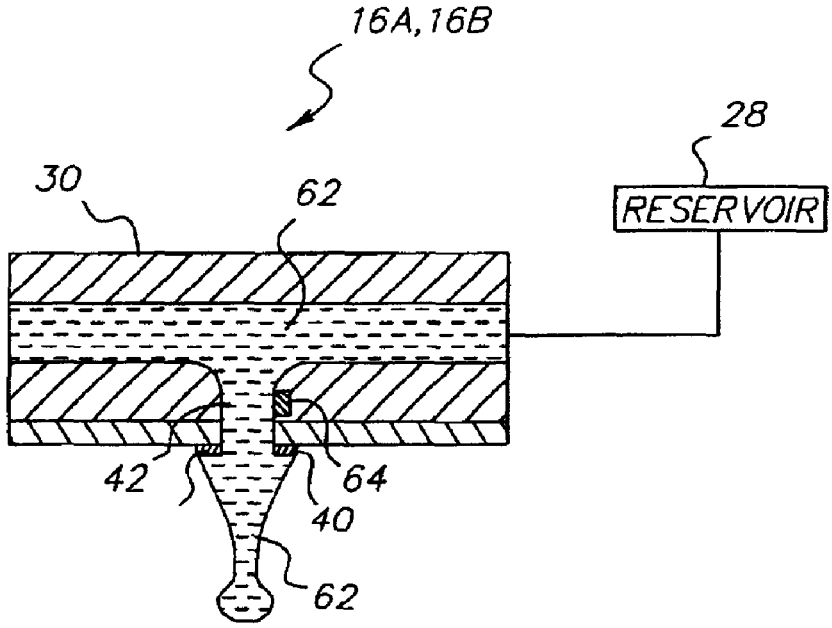
FIGS. 6C and 6D are side views of a printhead incorporating the present invention.
Figure 6D:
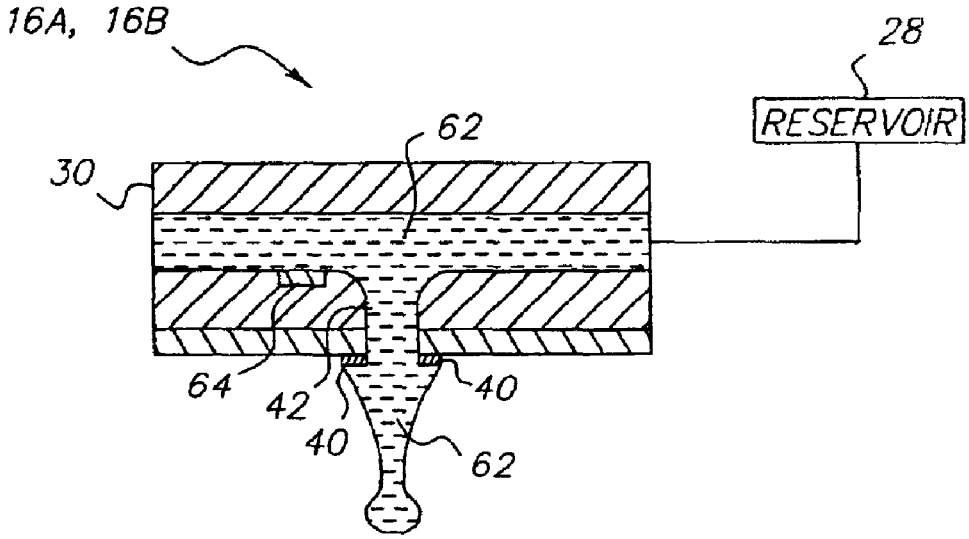

In FIG. 6A, at least one temperature sensing device 64 is positioned on printhead 16A, 16B, proximate to nozzle bore 42. In this embodiment, temperature sensing devices 64 are positioned at predetermined locations, for example, at opposite ends of nozzle row 66. In FIG. 6B, a temperature sensing device 64 is positioned next to each nozzle bore 42 in nozzle row 66. Alternatively, temperature sensing device 64 can be positioned within nozzle bore 42 (shown in FIG. 6C), or within ink delivery channel 30 (shown in FIG. 6D). Again, temperature sensing devices 64 can be positioned proximate to each nozzle bore 42 in nozzle row 66 or at predetermined locations, for example, at opposite ends of nozzle row 66 when temperature sensing device 64 is positioned within printhead 16A, 16B. In FIGS. 6C and 6D, nozzle row 66 extends into and out of the page. Each temperature sensing device 64 is connected to controller 24. Depending on the location of temperature sensing device 64 (e.g. in nozzle bore 42, in channel 30 proximate heater 40, etc.), the measured temperature reflects the actual ink temperature just prior to, just after, or substantially at ejection of the ink through nozzle bore 42. Alternatively, temperature sensing device 64 can be located anywhere along or in the ink flow path where the ink reaches substantial thermal equilibrium with the drop forming mechanism 38. Additionally, temperature sensing device 64 can be positioned at any location where a temperature signal is produced which is predictive of the ink temperature at the nozzle bore 42 through known thermal relationships between the location of temperature sensing device 64 and printhead 16A, 16B.

As discussed above, ink viscosity and other ink parameters can vary depending on the temperature of the ink and the surrounding operating environment. As such, the velocity of ink ejected through nozzle bores 42 will vary and the size of the ink drop formed will vary even though the activation times of the drop forming mechanism 38 (e.g. heater 40) remain constant.

Figure 7:
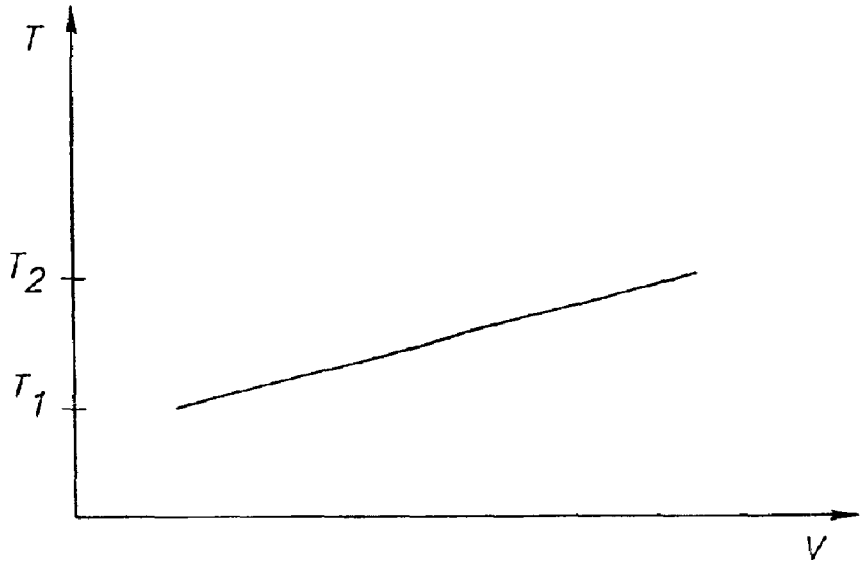
FIG. 7 is a graph of ink ejection velocity versus temperature.

Referring to FIG. 7 a graph showing a typical qualitative relationship between ink temperature and ink velocity (with other parameters, such as heater 40 and nozzle bore 42 geometry remaining constant) is shown. It can be seen that as temperature T increases from $T_1$ to $T_2$, and the velocity V of ink ejected through nozzle bore 42 increases due to a change in ink parameters such as viscosity which generally decreases. In this case, the difference between $T_1$ and $T_2$ is small enough to result in a generally linear relationship. However, the relationship can be of any type and can be determined mathematically or empirically.

Figure 8:
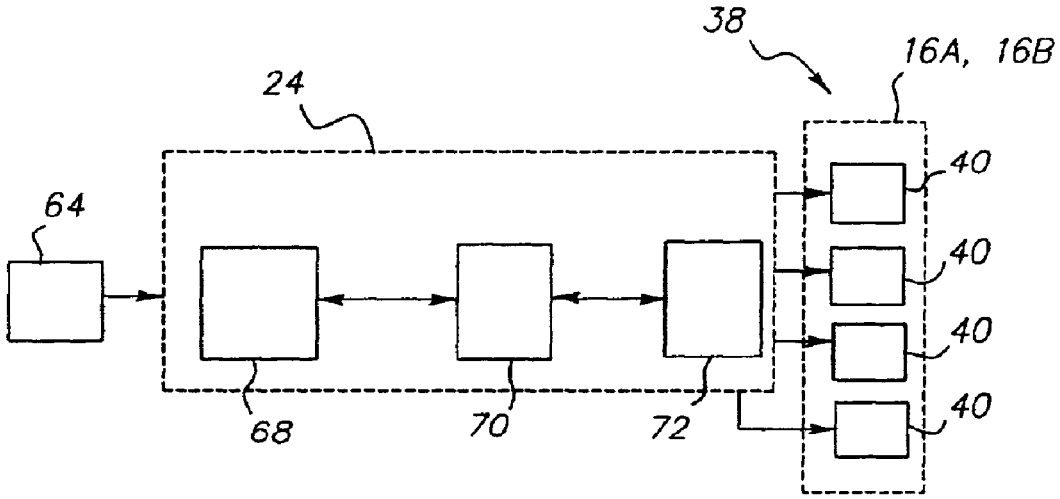
FIG. 8 is a block diagram of a controller incorporating the present invention.

Referring to FIG. 8, controller 24 includes a lookup table 68, a processor 70, and timing electronics 72, schematically shown. Temperature sensing device(s) 64 are connected to input(s) of controller 24 so that controller 24 receives input signals from temperature sensing device(s) 64. Drop forming mechanism 38 (e.g. heater 40) is coupled to outputs of controller 24 so that drop forming mechanism 38 (e.g. heater 40) receives output signal from controller 24. Lookup table 68 is populated with control data representing a desired time between pulses of the output signals to drop forming mechanism 38 (e.g. heater 40). The control data can be determined mathematically or through experiment. For example, print head 16A, 16B can be placed in a controlled environment and the velocity of ink flow through nozzle bore 42 can be measured at a plurality of ink temperatures to obtain a curve similar to that in FIG. 7. From this curve, the time period between pulses of the output signal resulting in activation of ink drop forming mechanism 38 (e.g. heater 40) can be set to achieve the desired ink drop size for a particular ink temperature. As one of ordinary skill in the art is well aware, interpolation and extrapolation can be used to extend the range and increase the resolution of the control data.

Processor 70 reads the signal from temperature sensing device 64 to determine the temperature of the ink. The temperature of the ink can be an average over a period of time or instantaneous. Processor 70 then locates the control data in lookup table 68 corresponding to the ink temperature and feeds the control data to an input of the timing electronics 72. Timing electronics 72 generates a pulsed control signal as the output signal to drop forming mechanism 38 (e.g. heater 40) in accordance with the control data. This process is repeated over time to vary the output signal to drop forming mechanism 38 (e.g. heater 40) as ink temperature changes.

Figure 9A:
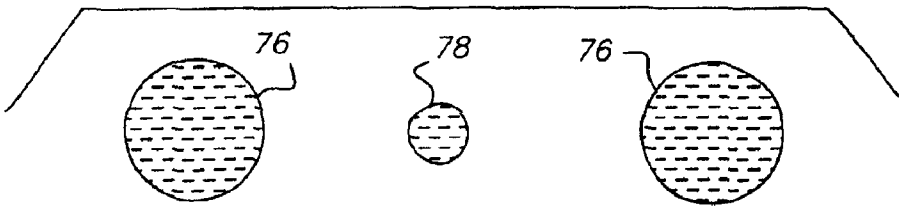
FIG. 9A are examples of drops formed by the waveforms shown in FIGS. 9B and 9C.
Figure 9B:
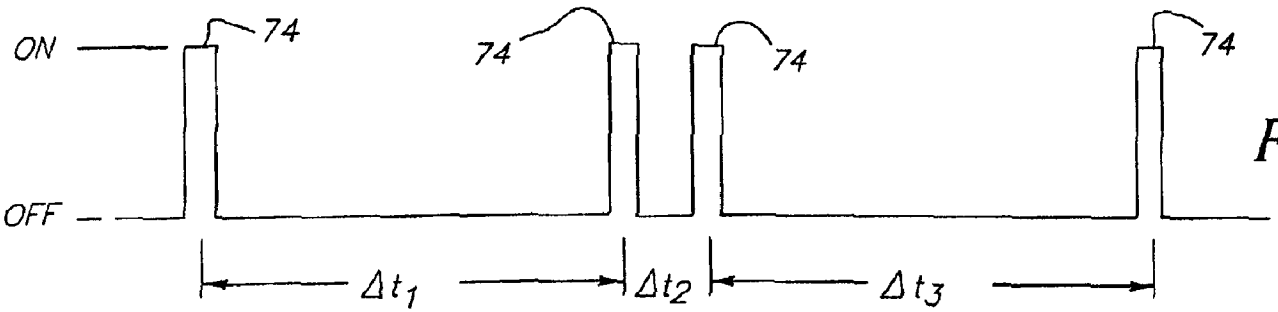
FIGS. 9B and 9C are drop forming mechanism activation wave forms used to produce the drops shown in FIG. 9A.
Figure 9C:
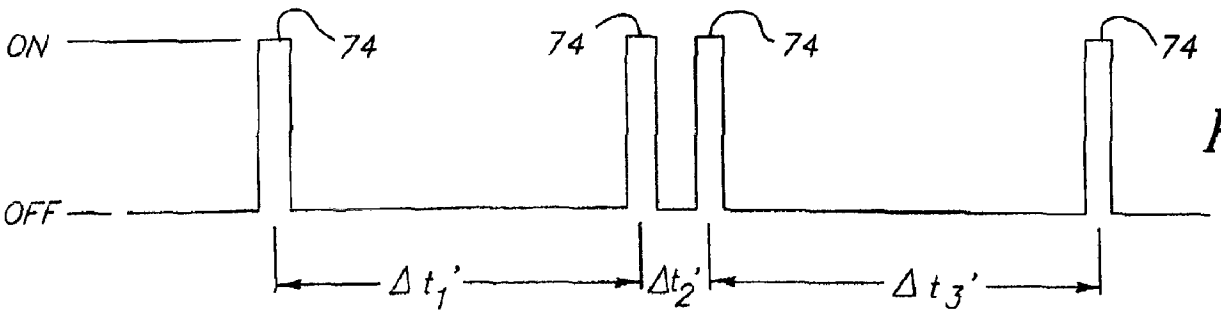

Referring to FIGS. 9B–9C, control signals to activate drop forming mechanism 38 (e.g. heater 40) versus time are shown. It can be seen that the time period between activation pulses 74 provided to drop forming mechanism 38 (e.g. heater 40) can be varied to create larger drops 76 or smaller drops 78 (shown in FIG. 9A) formed during time intervals $\Delta t_1$, $\Delta t_2$, and $\Delta t_3$, respectively. Generally, the relation $$V=\Delta t \times f,$$

where V is the drop volume, $\Delta t$ is the time interval between pulses, and f is the ink flow rate, is found for many inks to hold over a range of a factor of 50 in $\Delta t$, for a specified distance from the printhead. For example, the duration of each activation pulse 74 can be about 0.5 to 1 microsecond and the time period between pulses can be varied between 2 and 100 microseconds. As ink flow rate is temperature dependent, $\Delta t$ can be adjusted to compensate for a temperature change in the ink, so that the ejected drop volume remains constant. As ink temperature increases, ink viscosity generally decreases and ink flow rate increases. Accordingly, the time period between activation pulses can be decreased, from $\Delta t_1$, $\Delta t_2$, and $\Delta t_3$ to $\Delta t_1'$, $\Delta t_2'$, and $\Delta t_3'$, respectively, as shown in FIG. 9C so that the volumes of droplets 76, 78 remain constant. Alternatively, the time period between activation pulses can be increased. Additionally, the overall time period can vary depending on the ink temperature and ink viscosity of a particular ink. Although the control signals in FIGS. 9B and 9C are shown as a square wave form, the control signal can be of any appropriate type having various shapes.

This invention can be applied to any type of printhead having a drop forming mechanism 38 in which the time period between activation signals to the drop forming mechanism 38 can be varied or controlled. In the embodiment discussed above, drop forming mechanism 38 includes a heater 40 positioned proximate nozzle bore 42 used to break up a fluid stream into drops. Additionally, any type of drop deflector system, for example, heater 40, system 56, etc. can be used.

The relationship between ink viscosity and ink temperature can be of any type and can vary between inks of different types and colors. For example, the relationship may not be linear or the ink viscosity may increase with temperature and may be different for each nozzle. Accordingly, each nozzle bore 42 can have a corresponding temperature sensing device 64 so that selected portions of ink drop forming mechanism 38 can be controlled independently. Additionally, the relationship between ink temperature and ink viscosity can be stored or represented in controller 24 in any manner. For example, a mathematical algorithm, etc. can replace look up table 68. Ink temperature can also be monitored and appropriate timing changes made during printer operation which helps to maximize printer throughput.

Figure 10B:
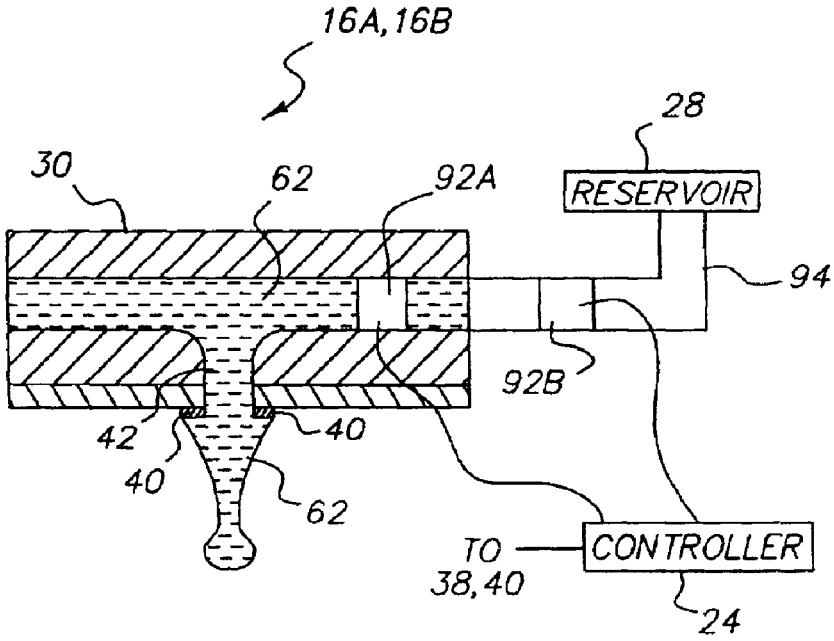
FIGS. 10A–10C are schematic side views of a printhead incorporating alternative embodiments of the present invention.
Figure 10A:
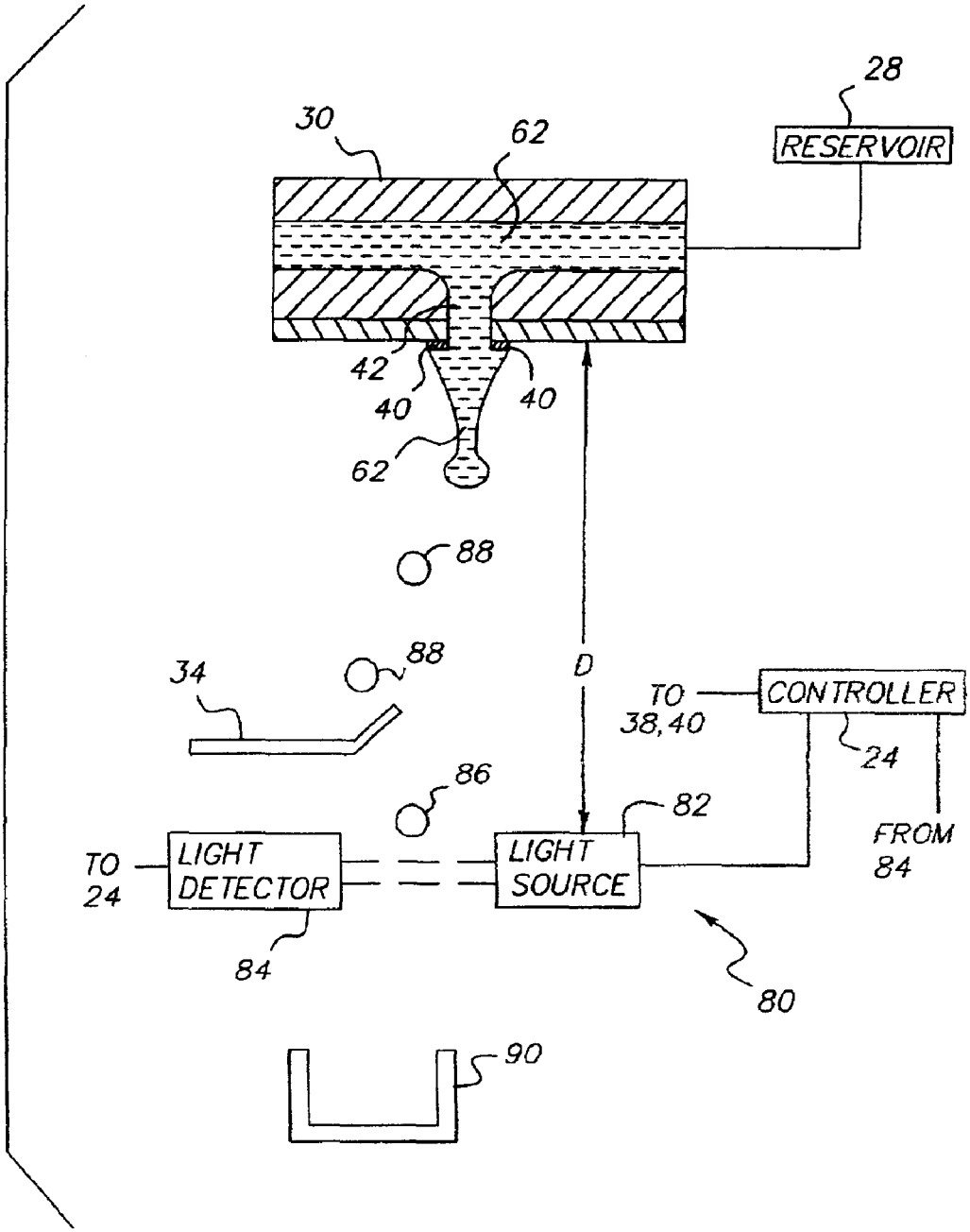

Referring to FIG. 10A, an alternative preferred embodiment is schematically shown. In this embodiment, the ejected drop velocity is determined by a velocity sensing device 80 using, for example, a time-of-flight velocity calculation method. Velocity sensing device 80 can include a co-linear light source 82 and a light detector 84, for example, a laser diode, and a photodiode, respectively. Velocity sensing device 80 is positioned a known distance D from printhead 16A, 16B. A drop 86 is ejected through nozzle bore 42 and passes through velocity sensing device 80. Other drops 88 are collected by gutter 34. After passing through velocity sensing device 80, drop 86 is collected in a container 90. The flow rate of the drop 86 is then calculated by controller 24. The timing between activation pulses 74 can be adjusted by controller 24 in direct proportion to the calculated ink flow rate using controller 24, so that a constant drop volume as a function of temperature, or another ink parameter is achieved. Typically, printhead 16A, 16B is moved to a position adjacent to the image recording media, for example, a printhead capping or maintenance station, prior to measuring drop velocity in this manner. Controller 24 can be of the type described with reference to FIG. 8, or can be of any known type suitable for varying the time period between activation pulses 74.

By appropriately positioning printhead 16A, 16B relative to velocity sensing device 80 and selectively actuating each drop forming mechanism 38 (e.g. heater 40), individual drop velocities associated with individual nozzle bores 42 can be determined. As such, the timing between activation pulses 74 can be adjusted independently on a nozzle by nozzle basis in order to achieve constant drop volumes. This particularly advantageous when using a page-width printhead 16A because temperatures across printhead 16A can vary substantially depending on frequency of heater activation, etc. Alternatively, a time-of-flight velocity calculation can be made for a smaller number of nozzle bores 42 with the activation timing adjustments for the entire printhead being determined by interpolation of the data, image data history, the amount of power dissipated at each nozzle, etc.

Referring to FIG. 10B, when the printhead, for example printhead 16B, remains at an essentially uniform temperature and does not experience localized areas of temperature increases or decreases, the time period between activation pulses of drop forming mechanism 38 (e.g. heater 40) can be adjusted by controller 24 to correct for temperature changes based on a measurement of ink flow rate through the printhead 16B. This ink flow rate can be determined by positioning a mass flow sensor 92A or 92B anywhere in the ink supply path to the printhead 16B. For example, mass flow sensor 92A can be positioned in ink channel 30. Alternatively, mass flow sensor 92B can be positioned in supply path 94 between reservoir 28 and printhead 16B. Advantages of measuring ink flow rate in this manner include being able to measure while the printer is operating which helps to maximize printer throughput. Controller 24 can be of the type described with reference to FIG. 8, or can be of any known type suitable for varying the time period between activation pulses 74.

Figure 10C:
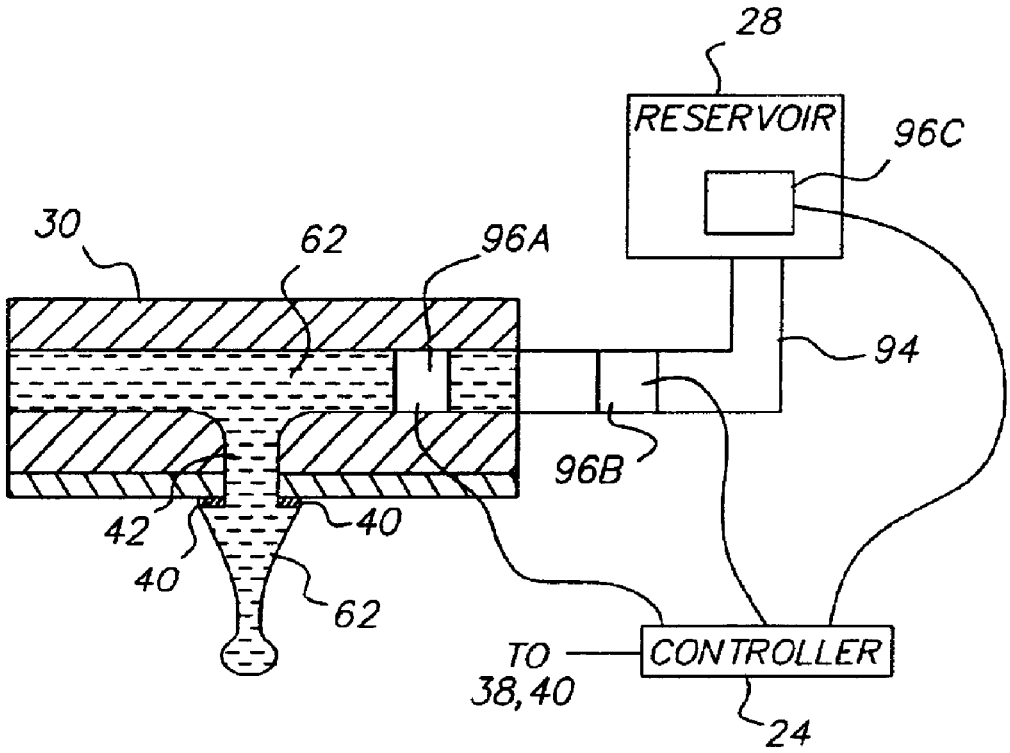

Referring to FIG. 10C, this invention can also be applied to compensate for changes in an ink parameter (for example, viscosity) that are not related to a change in ink temperature provided the time period between activation control signals provided to a drop forming mechanism can be varied. For example, individual formulations or batches of ink can have different viscosities. As such, ink viscosity can be determined by positioning a viscosity sensor 96A, 96B, or 96C anywhere in the ink supply path to the printhead 16A, 16B. For example, viscosity sensor 96A can be positioned in ink channel 30. Alternatively, viscosity sensor 96B can be positioned in supply path 94 between reservoir 28 and printhead 16B, or viscosity sensor 96C can be positioned in reservoir 28.

Controller 24 can adjust the time period between activation control signals supplied to drop forming mechanism 38 (for example, heater 40) based on the signal received from viscosity sensor 96A, 96B, or 96C. Controller 24 can be of the type described with reference to FIG. 8, or can be of any known type suitable for varying the time period between activation pulses 74. Alternatively, the embodiment described with reference to FIG. 10A can be used to determine changes in an ink parameter (for example, viscosity) that are not related to a change in ink temperature.

The invention has been described in detail with particular reference to certain preferred embodiments thereof, but it will be understood that variations and modifications can be effected within the scope of the invention.

What is claimed is:

1. A method of maintaining an ejected ink drop volume in a continuous inkjet printer comprising:

determining a change in an ink parameter of an ink;

varying a time period between activation control signals provided to an ink drop forming mechanism in response to the change in the ink parameter; and forming an ink drop from the ink using heat provided by the ink drop forming mechanism, wherein forming the ink drop from the ink using heat provided by the ink drop forming mechanism includes applying the heat asymmetrically to the ink to form the ink drop.

2. The method according to claim 1, wherein determining the change in the ink parameter includes monitoring a temperature of the ink.

3. The method according to claims 2, wherein varying the time period between activation control signals includes locating control data in a lookup table corresponding to the temperature of the ink and using the control data to vary the time period between activation control signals.

4. The method according to claim 1, wherein determining the change in the ink parameter includes monitoring a flow rate of the ink.

5. The method according to claim 4, wherein varying the time period between activation control signals includes locating control data in a lookup table corresponding to the flow rate of the ink and using the control data to vary the time period between activation control signals.

6. The method according to claim 1, wherein determining the change in the ink parameter includes monitoring a velocity of the ink.

7. The method according to claim 6, wherein varying the time period between activation control signals includes locating control data in a lookup table corresponding to the velocity of the ink and using the control data to vary the time period between activation control signals.

8. The method according to claim 1, wherein determining the change in the ink parameter includes monitoring a viscosity of the ink.

9. The method according to claim 8, wherein varying the time period between activation control signals includes locating control data in a lookup table corresponding to the viscosity of the ink and using the control data to vary the time period between activation control signals.

10. The method according to claim 1 further comprising:

selectively deflecting the ink drop.

11. The method according to claim 10, wherein selectively deflecting the ink drop includes selectively deflecting the ink drop using a gas flow.

12. The method according to claim 10, wherein selectively deflecting the ink drop includes selectively deflecting the ink drop using heat.

13. The method according to claim 1, wherein forming the ink drop from the ink using heat provided by the ink drop forming mechanism includes forming ink drops having a plurality of volumes.

14. The method according to claim 13, further comprising:

deflecting the ink drops having the plurality of volumes by applying a gas flow to the ink drops having the plurality of volumes.

15. An apparatus for continuously ejecting ink comprising:

a printhead, portions of which define a delivery channel and a nozzle bore, the delivery channel and nozzle bore defining an ink flow path;

a drop forming mechanism positioned proximate to the ink flow path that forms drops from ink moving along the ink flow path;

an ink parameter sensing device positioned proximate to the ink flow path; and a controller in electrical communication with the drop forming mechanism and the ink parameter sensing device configured to vary a time period between activation control signals provided to the drop forming mechanism in response to a change in an output signal received from the ink parameter sensing device, wherein the drop forming mechanism includes an asymmetric heater.

16. The apparatus according to claim 15, further comprising:

a drop deflector system, wherein the drop deflector system includes a gas flow.

17. The apparatus according to claim 15 further comprising:

a drop deflector system, wherein the drop deflector system includes the asymmetric heater.

18. The apparatus according to claim 15, wherein the ink parameter sensing device includes a temperature sensing device.

19. The apparatus according to claim 18, wherein the temperature sensing device is positioned in the delivery channel.

20. The apparatus according to claim 18, wherein the temperature sensing device is positioned in the nozzle bore.

21. The apparatus according to claim 18, wherein the temperature sensing device is positioned adjacent to the drop forming mechanism.

22. The apparatus according to claim 15, wherein the ink parameter sensing device includes a velocity sensing device positioned a predetermined distance from the printhead.

23. The apparatus according to claim 15, wherein the ink parameter sensing device includes a mass flow sensing device.

24. The apparatus according to claim 23, wherein the mass flow sensing device is positioned in the delivery channel.

25. The apparatus according to claim 23 further comprising:

an ink reservoir connected to the delivery channel of the printhead by a supply line, wherein the mass flow sensing device is positioned in the supply line.

26. The apparatus according to claim 15, wherein the ink parameter sensing device includes a viscosity sensing device.

27. The apparatus according to claim 26, wherein the viscosity sensing device is positioned in the delivery channel.

28. The apparatus according to claim 26 further comprising:

an ink reservoir connected to the delivery channel of the printhead by a supply line, wherein the viscosity sensing device is positioned in the supply line.

29. The apparatus according to claim 15, wherein the controller comprises a processor, a lookup table storing data related to the ink parameter, and a timing control circuit.

30. A method of maintaining an ejected ink drop volume in a continuous inkjet printer comprising:

determining a change in an ink parameter of an ink;

varying a time period between activation control signals provided to an ink drop forming mechanism in response to the change in the ink parameter; and forming an ink drop from the ink using heat provided by the ink drop forming mechanism, wherein forming the ink drop from the ink using heat provided by the ink drop forming mechanism includes forming ink drops having a plurality of volumes by applying the heat asymmetrically to the ink.

31. The method according to claim 30, further comprising:

deflecting the ink drops having the plurality of volumes by applying a gas flow to the ink drops having the plurality of volumes.

32. An apparatus for continuously ejecting ink comprising:

a printhead, portions of which define a delivery channel and a nozzle bore, the delivery channel and nozzle bore defining an ink flow path;

a drop forming mechanism positioned proximate to the ink flow path that forms drops from ink moving along the ink flow path;

a drop deflector system, the drop deflector system including a gas flow;

an ink parameter sensing device positioned proximate to the ink flow path; and a controller in electrical communication with the drop forming mechanism and the ink parameter sensing device configured to vary a time period between activation control signals provided to the drop forming mechanism in response to a change in an output signal received from the ink parameter sensing device, wherein the drop forming mechanism includes an asymmetric heater.

33. The apparatus according to claim 32, wherein the drop forming mechanism is operable to form drops having a plurality of volumes.

* * * * *